US006168297B1

(12) United States Patent
Tatsukawa

(10) Patent No.: US 6,168,297 B1
(45) Date of Patent: Jan. 2, 2001

(54) VEHICULAR HEADLAMP ASSEMBLY WITH DISCHARGE BULB AND GLARE PROTECTION FILM

(75) Inventor: Masashi Tatsukawa, Shizuoka (JP)

(73) Assignee: Koito Manufacturing Co., Ltd., Tokyo (JP)

( * ) Notice: Under 35 U.S.C. 154(b), the term of this patent shall be extended for 0 days.

(21) Appl. No.: 09/436,752

(22) Filed: Nov. 9, 1999

(30) Foreign Application Priority Data

Nov. 17, 1998 (JP) ..... 10-326694

(51) Int. Cl.[7] ..... F21V 11/00
(52) U.S. Cl. ..... 362/351; 362/255; 362/539
(58) Field of Search ..... 362/351, 255, 362/256, 539, 509

(56) References Cited

U.S. PATENT DOCUMENTS 4,740,875 * 4/1988 Wyckoff et al. ..... 362/336
5,195,815 * 3/1993 Watanabe et al. ..... 362/510
5,299,101 3/1994 Serizawa ..... 362/510
5,587,626 * 12/1996 Parham et al. ..... 313/624

* cited by examiner

*Primary Examiner*—Alan Cariaso
*Assistant Examiner*—Ronald E. DelGizzi
(74) *Attorney, Agent, or Firm*—Sughrue, Mion, Zinn, Macpeak & Seas, PLLC

(57) ABSTRACT

A vehicular headlamp comprising a discharge bulb provided with an arc tube having a discharge light-emitting portion extending in a fore-to-aft direction, an outer tube tubularly surrounding the arc tube, and a glare protection film formed on an outer peripheral surface of the outer tube over a predetermined angular range such that upper edges of the glare protection film are located on left and right sides of the outer peripheral face, and a reflector that securely supports the discharge bulb and reflects light from the discharge light-emitting portion of the discharge bulb forward, characterized in that the discharge bulb is securely supported by the reflector so that the upper edges of the glare protection film are located substantially at an equal height, that is, the upper edges are disposed in a horizontal plane.

11 Claims, 8 Drawing Sheets

VEHICULAR HEADLAMP ASSEMBLY WITH DISCHARGE BULB AND GLARE PROTECTION FILM

FIELD OF THE INVENTION

The present invention relates to a vehicular headlamp provided with a discharge bulb as a light source.

BACKGROUND OF THE INVENTION

In recent years, a discharge bulb has been widely adopted as a light source for vehicular headlamps because of its high intensity light output.

The discharge bulb is generally provided with an arc tube having a discharge light-emitting portion extending in the fore-to-aft direction. In order to be used as a light source for low-beam emission, there is also known a discharge bulb wherein an outer tube tubularly surrounding the arc tube is provided and a glare protection film is formed on the outer peripheral surface of the outer tube.

In a discharge bulb of this type, as shown in FIG. 7, a glare protection film 128 is formed such that upper edges 128L*a*, 128R*a* thereof are located on left and right sides of an outer peripheral face 126*a* of an outer tube 126. The angular range of the glare protection film 128 is set to 165°, with the center being a discharge light-emitting portion 124*a*. In many cases, the glare protection film 128 is formed as a pair of left and right black stripes 128L, 128R with the glare protection film being omitted in a lower area of the outer peripheral face 126*a*, as can be seen from FIG. 7.

A discharge bulb 118 is securely supported by a reflector such that one of the upper edges of the glare protection film 128 (the upper edge 128R*a* of the right-side black stripe 128R in FIG. 7) is located at the same height as the discharge light-emitting portion 124*a* (more precisely, a line connecting both end electrodes of the discharge light-emitting portion 24*a* lies in the same horizontal plane as the upper edge 124R*a*). As a result, there is produced a light distribution pattern P' having a horizontal cut-off line CL1' and an inclined cut-off line CL2' rising from the horizontal cut-off line CL1' with an angle of 15°, as is apparent from FIG. 8.

During adjustment of the beams (aiming) at the time of low-beam emission, aiming in the up-and-down direction is performed with the location of the horizontal cut-off line adopted as a base. Therefore, the dark-light ratio of the is horizontal cut-off line needs to be enhanced sufficiently.

However, if the dark-light ratio of the horizontal cut-off line is set too high, in the case where, for example, the vehicle enters a flat road after having descended a slope, there is a possibility, depending on the running condition of the vehicle, that the visibility of the road far ahead of the vehicle deteriorates due to sudden darkening, making it difficult for the driver to properly drive the vehicle. Further, if the horizontal cut-off line is displaced slightly upward or downward owing to pitching of the vehicle or the like, there is a risk of dazzling drivers of oncoming vehicles.

In particular, in the case where a discharge bulb is used as a light source of the headlamp, since the discharge bulb has much greater power than a halogen bulb or the like, the aforementioned problem is exacerbated.

The present invention has been made in consideration of such circumstances.

SUMMARY OF THE INVENTION

It is an object of the present invention to provide a vehicular headlamp equipped with a discharge bulb which provides a light distribution pattern for low-beam emission that facilitates driving of the vehicle and minimizes the risk of dazzling drivers of oncoming vehicles.

The present invention is designed to achieve the above-stated object by the provision of an appropriate structure wherein the discharge bulb is securely supported by the reflector.

According to the present invention, there is provided a vehicular headlamp including a discharge bulb provided with an arc tube having a discharge light-emitting portion extending in the fore-to-aft direction, an outer tube tubularly surrounding the arc tube having a glare protection film formed on an outer peripheral surface thereof over a predetermined angular range such that the upper edges of the glare protection film are located on left and right sides of the outer peripheral surface, and a reflector that securely supports the discharge bulb and reflects light from the discharge light-emitting portion of the discharge bulb forward, wherein the discharge bulb is securely supported by the reflector and the upper edges of the glare protection film are located substantially at an equal height, that is, the upper edges are located in a horizontal plane.

The "predetermined angular range" mentioned above refers to the entire angular range between the upper edges of the glare protection film. If there is a section within the angular range where the glare protection film is not formed, the predetermined angular range also includes an angular range corresponding to the section.

As indicated by the aforementioned construction, a vehicular headlamp according to the present invention employs a discharge bulb having the glare protection film as a light source thereof, and the discharge bulb is securely supported by the reflector such that the upper edges of the glare protection film are located substantially at an equal height on the left and right sides of the outer peripheral surface of the outer tube. By arranging these upper edges in proper position to the optical axis of the reflector, a light distribution pattern having horizontal cut-off lines on left and right sides of a line V (i.e., the vertical line perpendicular to the lighting fixture reference axis, see FIG. 3) is obtained.

Light distribution of the reflector, the lens or the like can be controlled to transform the horizontal cut-off lines into left and right horizontal cut-off lines that are on different levels, and thus an appropriate light distribution pattern for low-beam emission can be obtained.

For a light distribution pattern having left and right horizontal cut-off lines that are on different levels, either the location of the left-side horizontal line or the location of the right-side horizontal line can be adopted as a base for aiming in up-and-down directions. If aiming in the up-and-down direction is performed with the high-level horizontal cut-off line as a base, there is no need to significantly enhance the dark-light ratio as to the low-level horizontal cut-off line.

Accordingly, by setting the dark-light ratio of the low-level horizontal cut-off line and the location of the low-level horizontal cut-off line properly, even in the case where, for example, the vehicle enters a flat road after having descended a slope, deterioration in visibility of the road far ahead of the vehicle resulting from sudden darkening is inhibited. Further, even if the horizontal cut-off line is slightly displaced upward or downward, owing to pitching of the vehicle or the like, the luminous intensity of light emitted upward is prevented from becoming too high. Therefore, the risk of dazzling drivers of oncoming vehicles is reduced.

Thus, the present invention provides a vehicular headlamp is using a discharge bulb as a light source, and having a light distribution pattern for low-beam emission that facilitates driving of the vehicle, and minimizes the risk of dazzling drivers of oncoming vehicles.

Further, as described above, according to the present invention, the aiming operation can be performed with the location of the high-level horizontal cut-off line adopted as a base. Wherein, the target location of the aiming operation is set so that the high-level horizontal cut-off line coincides with a line H (i.e. the horizontal line perpendicular to the lighting fixture reference axis). Therefore, even if no special equipment for aiming measurement is used, the aiming operation of the light distribution pattern can be easily performed merely by making the high-level horizontal cut-off line coincident with the road clearance of the lighting fixture reference axis.

In the present invention, in order to obtain a light distribution pattern having horizontal cut-off lines on the left and right sides of the line V, the upper edges of the glare protection film of the discharge bulb need to be suitably positioned in relation to the lighting fixture reference axis. The construction for such arrangement, however, is not specifically limited.

For example, the predetermined angular range may be set to about 180° with the center being the discharge light-emitting portion. In this construction, it is possible to obtain a light distribution pattern having horizontal cut-off lines on the left and right sides of the line V merely by modifying an existing discharge bulb.

In a further example, the predetermined angular range may be set to about 165° with the center being the discharge light-emitting portion. The discharge bulb may also be securely supported by the reflector such that the optical axis of the discharge bulb is offset upward by a predetermined angle with respect to an optical axis of the reflector. In this construction, it is possible to obtain a light distribution pattern having horizontal cut-off lines on the left and right sides of the line V by directly utilizing an existing discharge bulb. Moreover, in this case, as compared to the previous example, the light flux from the light source utilized for low-beam emission is increased in accordance with the difference in angular range (15°), whereby the efficiency of the lighting fixture is enhanced.

DESCRIPTION OF THE PREFERRED EMBODIMENTS

Preferred embodiments of the present invention will be described hereinafter with reference to the drawings.

The first embodiment of the present invention will now be described with reference to FIGS. 1–3.

Figure 1:
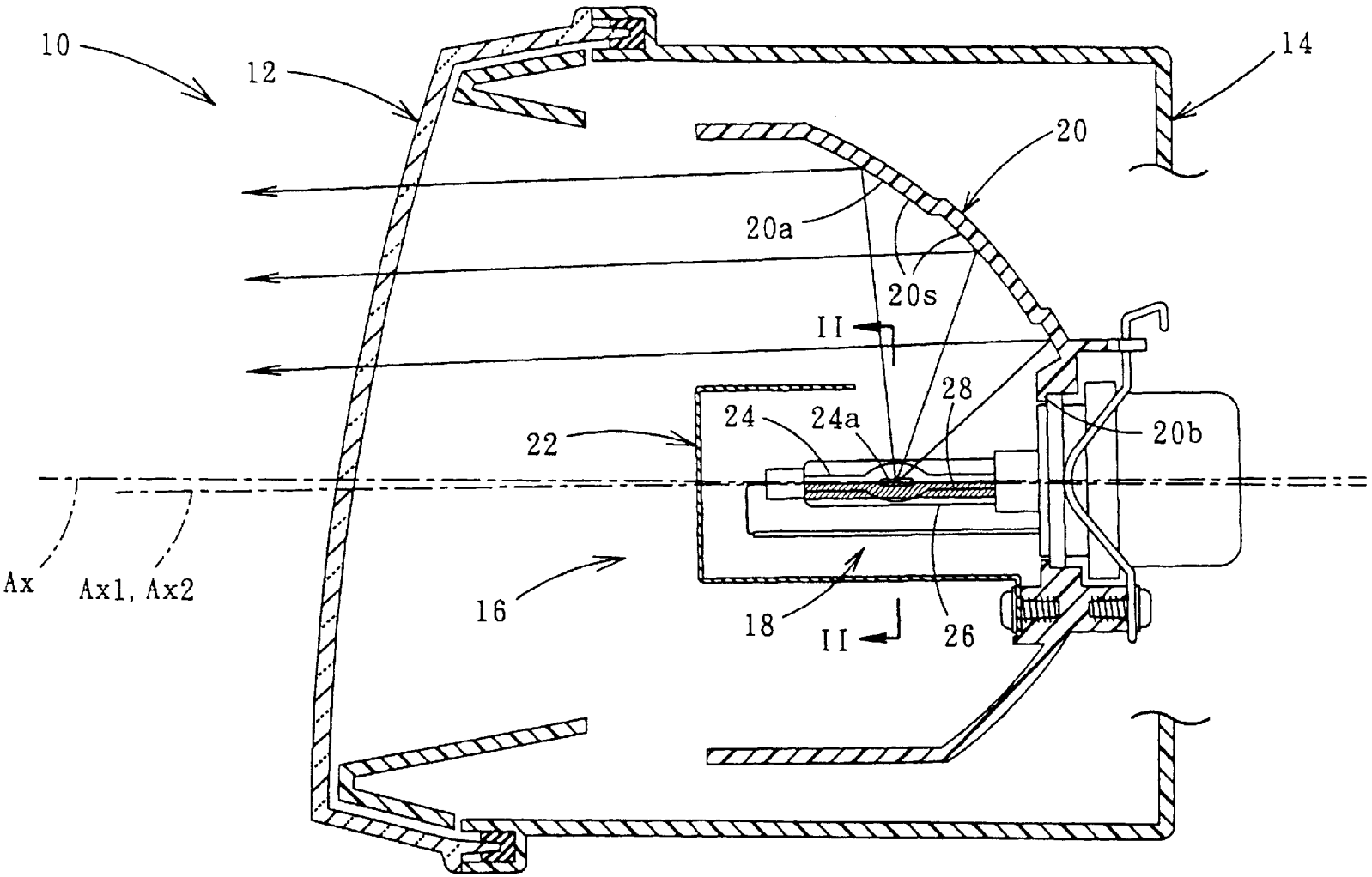
FIG. 1 is a side sectional view of a vehicular headlamp according to a first embodiment of the present invention.

FIG. 1 is a side sectional view of a vehicular headlamp 10 according to the present embodiment. FIG. 2 is detailed sectional view taken along a line II—II in FIG. 1.

As shown in FIG. 1, the vehicular headlamp 10 includes a reflector unit 16 that is tiltable in an up-and down direction and a left-and-right direction, and is disposed in a lighting chamber formed of a lens 12 and a lamp body 14.

The reflector unit 16 is provided with a discharge bulb 18 serving as a light source, a reflector 20 and a shade 22.

The discharge bulb 18 is a metal halide lamp provided with an arc tube 24 having a discharge light-emitting portion 24*a* that extends in a fore-to-aft direction and an outer tube 26 tubularly surrounding the arc tube 24. The discharge bulb 18 is securely supported by the reflector 20*a* by insertable attachment (insertion) into a bulb insertion-attachment portion 20*b* at a rear (opposite the direction of light propagation along an optical axis) peak portion of the reflector 20.

The reflector 20 has a reflecting surface 20*a* that is composed of a plurality of reflector elements 20*s* formed on a paraboloid of revolution the center axis of which is the optical axis Ax1 of the reflector 20. The reflecting surface 20*a* reflects the light from the discharge light-emitting portion 24*a* forward (toward the larger, open end of the paraboloid reflector) in a diffusing and deflecting manner, whereby a light distribution pattern for low-beam emission (later-described) is obtained. The lens 12 is composed of a transparent lens.

The reflector unit 16 is supported by the lamp body 14 such that the optical axis Ax1 of the reflector 20 is offset slightly downward with respect to a lighting fixture reference axis Ax (a horizontal line passing through a reference position of the lighting fixture and extending in fore-to-aft directions). The discharge bulb 18 is securely supported by the reflector 20 such that the optical axis Ax2 (a line connecting both end electrodes of the discharge light-emitting portion 24*a*) is aligned with the optical axis Ax1 of the reflector 20.

Figure 2:
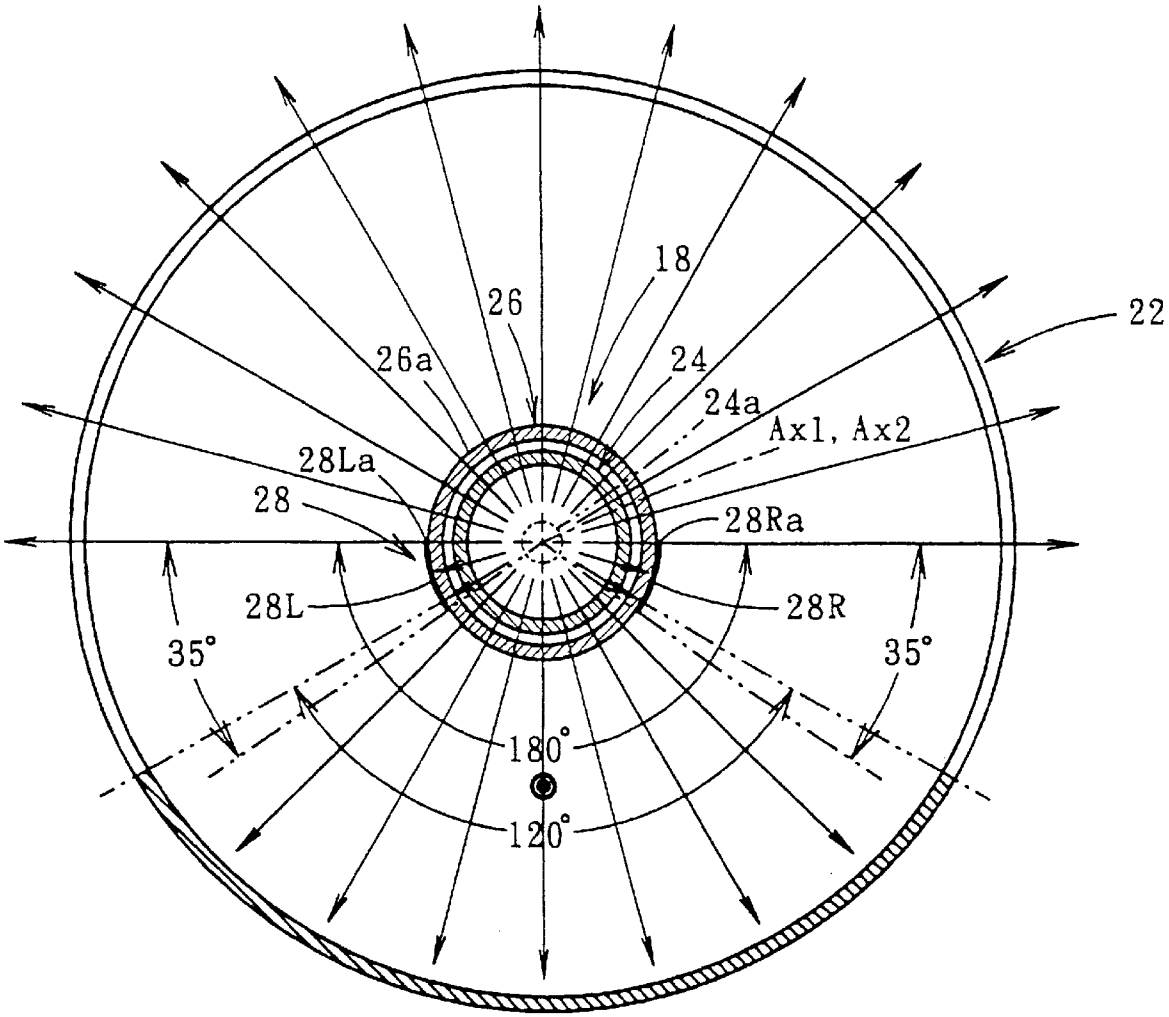
FIG. 2 is a detailed sectional view taken along a line II—II in FIG. 1.

As shown in FIG. 2, a glare protection film 28 is formed on the outer peripheral surface 26*a* of the outer tube 26 of the discharge bulb 18. The glare protection film 28 is composed of a pair of black (opaque) substantially rectangular stripes 28L, 28R that extend in the direction of the optical axis Ax2 on left and right sides of the outer peripheral surface 26*a* of the outer tube 26. The angular range for formation of the glare protection film 28 is set so that the angle between upper edges 28L*a*, 28R*a* of the black stripes 28L, 28R is equal to 180°. The discharge bulb 18 is securely supported by the reflector 20 such that the is upper edges 28L*a*, 28R*a* of the glare protection film 28 are located at the same height (i.e., at the same height as the optical axis Ax2). The angle (angular width) between upper and lower edges of each of the black stripes 28L, 28R is 35°.

As shown in FIG. 1, the shade 22 is securely attached to the reflector 20 and surrounds a front end portion and a lower portion of the discharge bulb 18. The shade 22 blocks light emitted from the discharge light-emitting portion 24*a* of the discharge bulb 18 from travelling directly toward the front of the lighting fixture and a lower area of the reflecting surface 20*a*, and surrounds the discharge bulb 18 over an angular range of 120° below the discharge light-emitting portion 24*a*, Thereby. light travelling downward from the discharge light-emitting portion 24*a* through a section between the black stripes 28L, 28R where the glare protection film is not formed is blocked.

Figure 3:
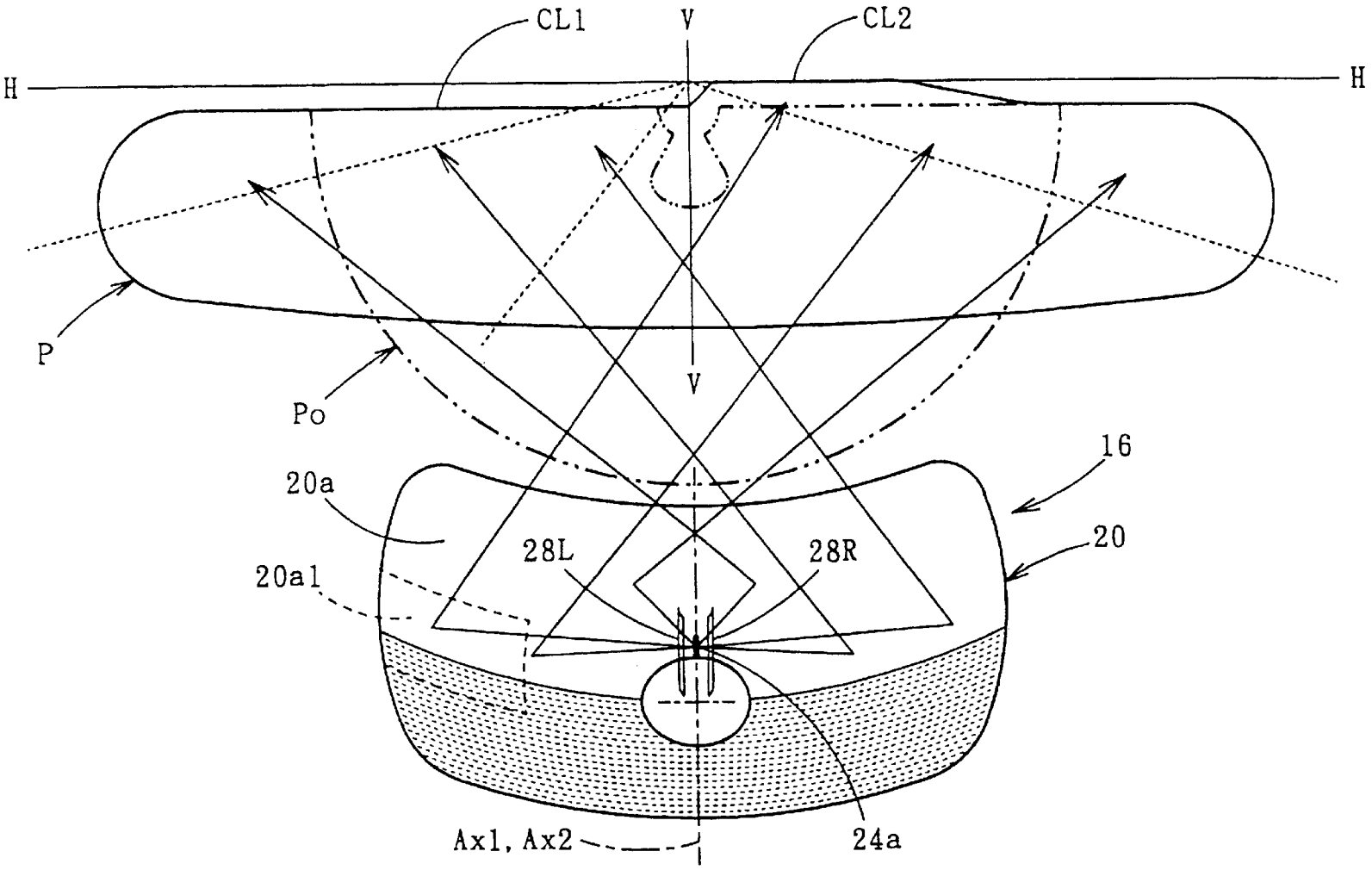
FIG. 3 illustrates a light distribution pattern for low-beam emission that is formed by the vehicular headlamp according to the first embodiment, together with a reflector unit.

FIG. 3 shows, together with the reflector unit 16, a light distribution pattern P for low-beam emission of the vehicular headlamp 10.

In the present embodiment, the upper edges 28L*a*, 28R*a* of the pair of the left and right black stripes 28L, 28R constituting the glare protection film 28 are located at the same height as the optical axis Ax2 of the discharge bulb 18 and the optical axis Ax1 of the reflector 20. Therefore, light from the discharge light-emitting portion 24*a* of the discharge bulb 18 is incident to the upper half of the reflecting surface 20*a* of the reflector 20.

If it is assumed that the reflecting surface 20*a* is a is paraboloid of revolution (paraboloid), the center of which is the optical axis Ax1, the light distribution pattern formed by the light reflected therefrom is a substantially semicircular light distribution pattern $P_o$, the upper edge of which is located slightly below a line H, as indicated by a line (of alternate long and two short dashes) in FIG. 3. However, in the present embodiment, the light distribution pattern $P_o$ is transformed through a diffusion-deflection reflection control function of the reflector elements 20*s* formed on the reflecting surface 20*a*. As a result, a light distribution pattern P as indicated by a solid line in FIG. 3 is formed.

The light distribution pattern P is a right-side light distribution pattern (for headlamp located on the right side of a vehicle) and has horizontal cut-off lines CL1, CL2 on left and right sides of a line V. The horizontal cut-off lines CL1, CL2 are on different levels. The left-side horizontal cut-off line CL1 is located slightly below the line H, and is formed by directly utilizing the upper edge of the light distribution pattern $P_o$. On the other hand, the right-side horizontal cut-off line CL2 is partially located on the line H, and is formed by displacing part of the upper edge of the light distribution pattern $P_o$ upward. In order to form the right-side horizontal cut-off line CL2, the reflector elements 20*s* constituting a left end area 20*a*1 of the reflecting surface 20*a* are designed to reflect light from the discharge light-emitting portion 24*a* upward in a deflecting manner.

For the light distribution pattern P having the horizontal cut-off lines CL1, CL2 on different levels as mentioned above, is either the location of the left-side horizontal line CL1 or the location of the right-side horizontal line CL2 can be adopted as a base for performing the aiming operation in an up-and-down direction.

If aiming in the up-and-down direction is performed with the high-level horizontal cut-off line CL2 adopted as a base, there is no need to enhance the dark-light ratio of the low-level horizontal cut-off line CL1.

Accordingly, by setting the dark-light ratio and the location of the low-level horizontal cut-off line CL1 properly, even in the case where, for example, the vehicle enters a flat road after having descended a slope, deterioration in visibility of the road far ahead of the vehicle resulting from sudden darkening is inhibited. Further, even if the horizontal cut-off line CL1 is slightly displaced upward or downward, owing to pitching of the vehicle or the like, the luminous intensity of light emitted upward is prevented from becoming too high. Therefore, the risk of dazzling drivers of oncoming vehicles is reduced.

Thus, the present embodiment provides a vehicular headlamp using a discharge bulb as a light source, and having a light distribution pattern for low-beam emission that facilitates driving of the vehicle, and minimizes the risk of dazzling drivers of oncoming vehicles.

Further, in the vehicular headlamp 10 according to the present embodiment, in the case where aiming in the up-and-down direction is performed using the location of the high-level horizontal cut-off line CL2 as a base, the location where the horizontal cut-off line CL2 coincides with the line H is set as a target location. Therefore, even if no special equipment for aiming measurement is used, the aiming operation can be performed, wherein a light distribution pattern of the headlamp is emitted onto a wall or the like in front of the vehicle and through a simple operation, the high-level horizontal cut-off line CL2 is made coincident with the road clearance of the lighting fixture reference axis Ax.

Additionally, in the present embodiment, the light distribution pattern P having the horizontal cut-off lines CL1, CL2 on the left and right sides of the line V can be obtained merely by modifying an existing discharge bulb (i.e. merely by setting the upper edges 28L*a*, 2SR*a* of the glare protection film 28 to an angular range of 180° with the center being the optical axis Ax2 of the discharge bulb 18).

A second embodiment of the present invention will be described with reference to FIGS. 4–6.

Figure 4:
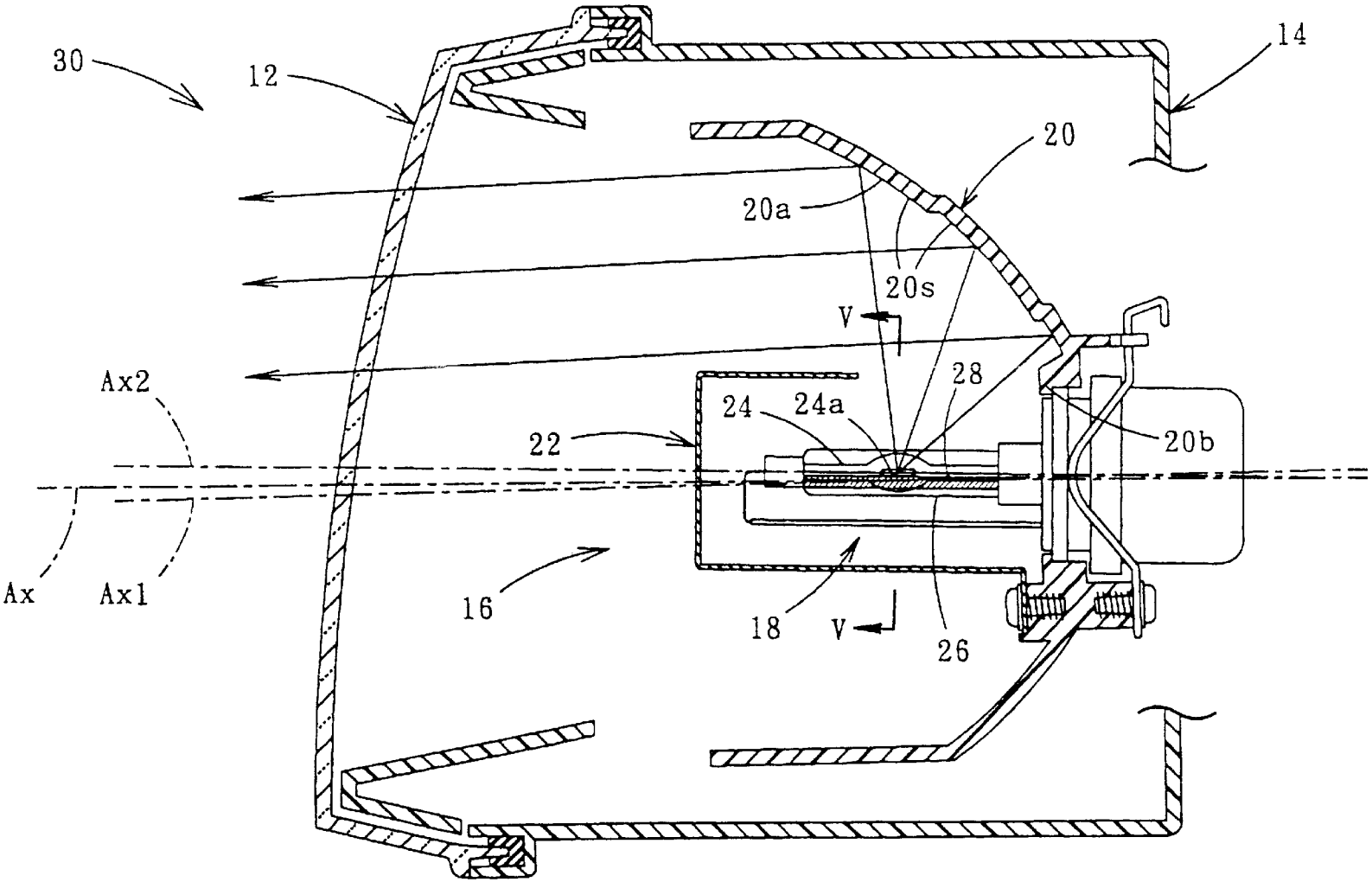
FIG. 4 is a side sectional view of a vehicular headlamp according to a second embodiment of the present invention.
Figure 5:
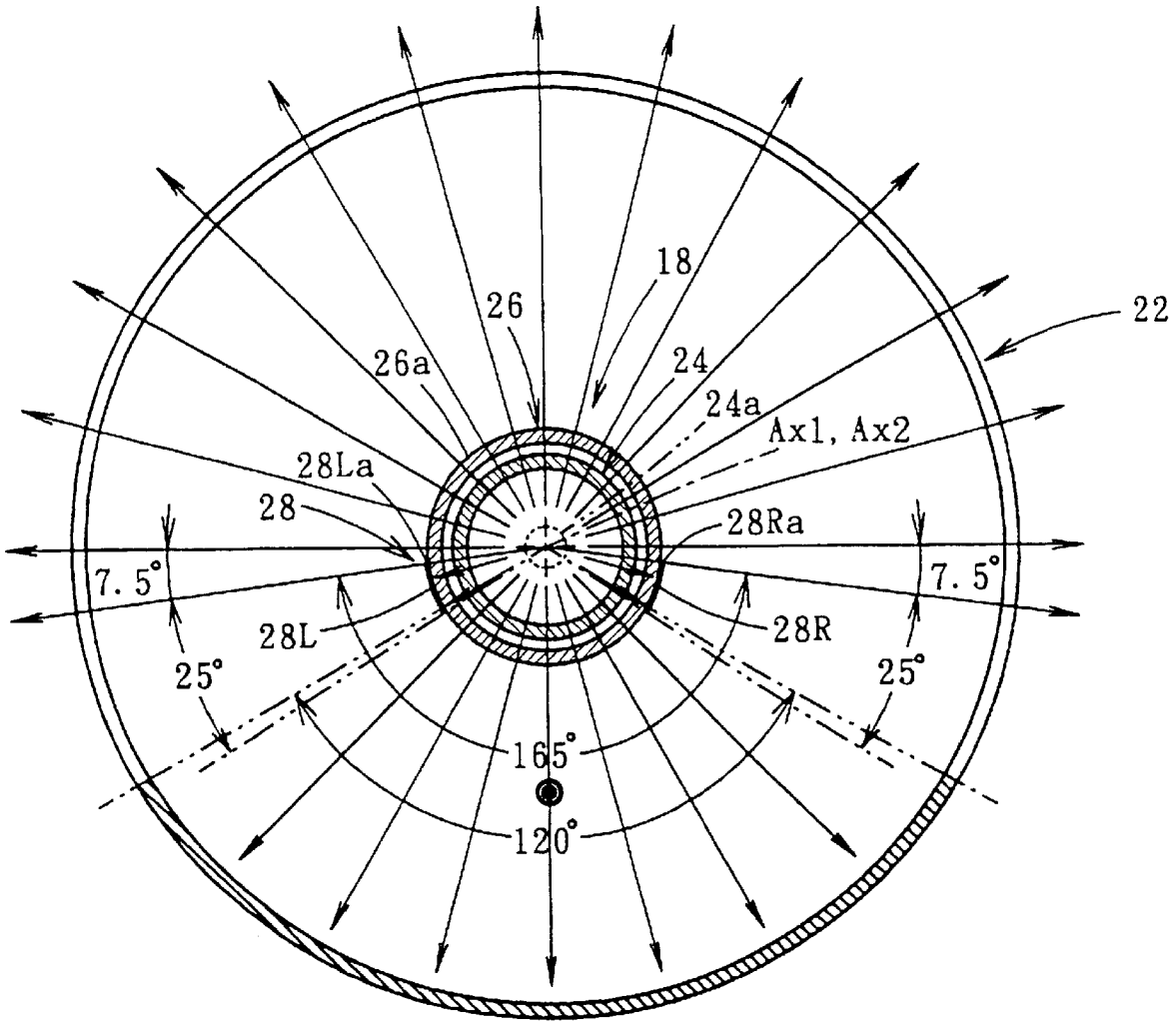
FIG. 5 is a detailed sectional view taken along a line V—V in FIG. 4.

FIG. 4 is a side sectional view of a vehicular headlamp 30 according to the present embodiment, and FIG. 5 is a detailed sectional view taken along a line V—V in FIG. 4.

As shown in FIG. 4, the vehicular headlamp 30 is essentially constructed in the same manner as the vehicular headlamp 10 of the first embodiment. However, the vehicular headlamp 30 is different from the vehicular headlamp 10 in location of the glare protection film 28 formed on the discharge bulb 18 and in location of the discharge bulb 18 attached to the reflector 20.

That is, the angular range for formation of the glare protection film 28 in the present embodiment is set so that the is angle between the upper edges 28L*a*, 28R*a* of the black stripes 28L, 28R is equal to 165°. The angle between the upper and lower edges of each of the black stripes 28L, 28R is 25°.

Further, in the present embodiment, the discharge bulb 18 is securely supported by the reflector 20 such that the upper edges 28L*a*, 28R*a* of the glare protection film 28 are located at the same height and the optical axis Ax2 of the discharge bulb 18 is offset slightly upward with respect to the optical axis Ax1 of the reflector 20 (i.e. left and right angular positions of 28L*a* and 28R*a* are offset diagonally downward from the optical axis Ax2 by 7.5°). The offsetting of the optical axis Ax2 is accomplished by forming the bulb insertion-attachment portion 20*b* of the reflector 20 in a tilted state.

Figure 6:
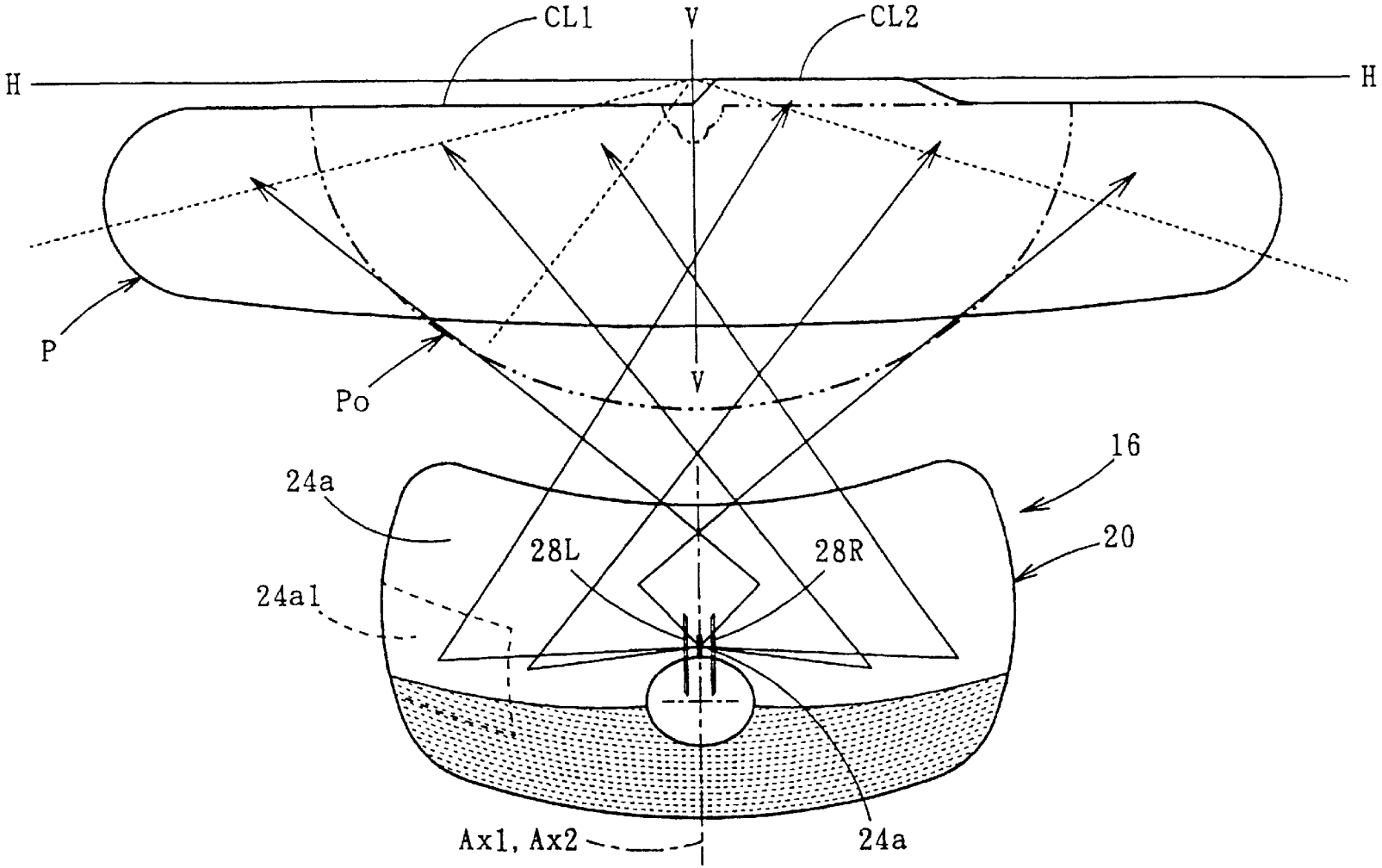
FIG. 6 illustrates a light distribution pattern for low-beam emission that is formed by the vehicular headlamp according is to the second embodiment, together with a reflector unit.
Figure 7:
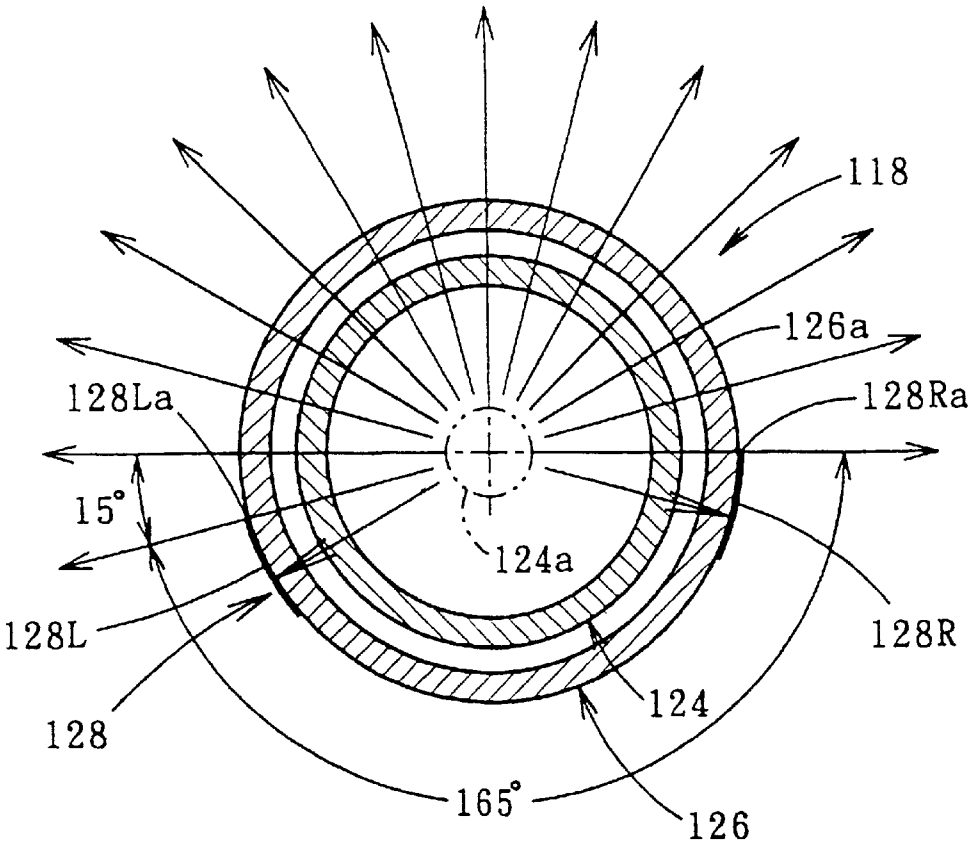
FIG. 7 PRIOR ART
FIG. 7 illustrates a detailed sectional view of a conventional vehicular headlamp which is similar to FIG. 2.
Figure 8:
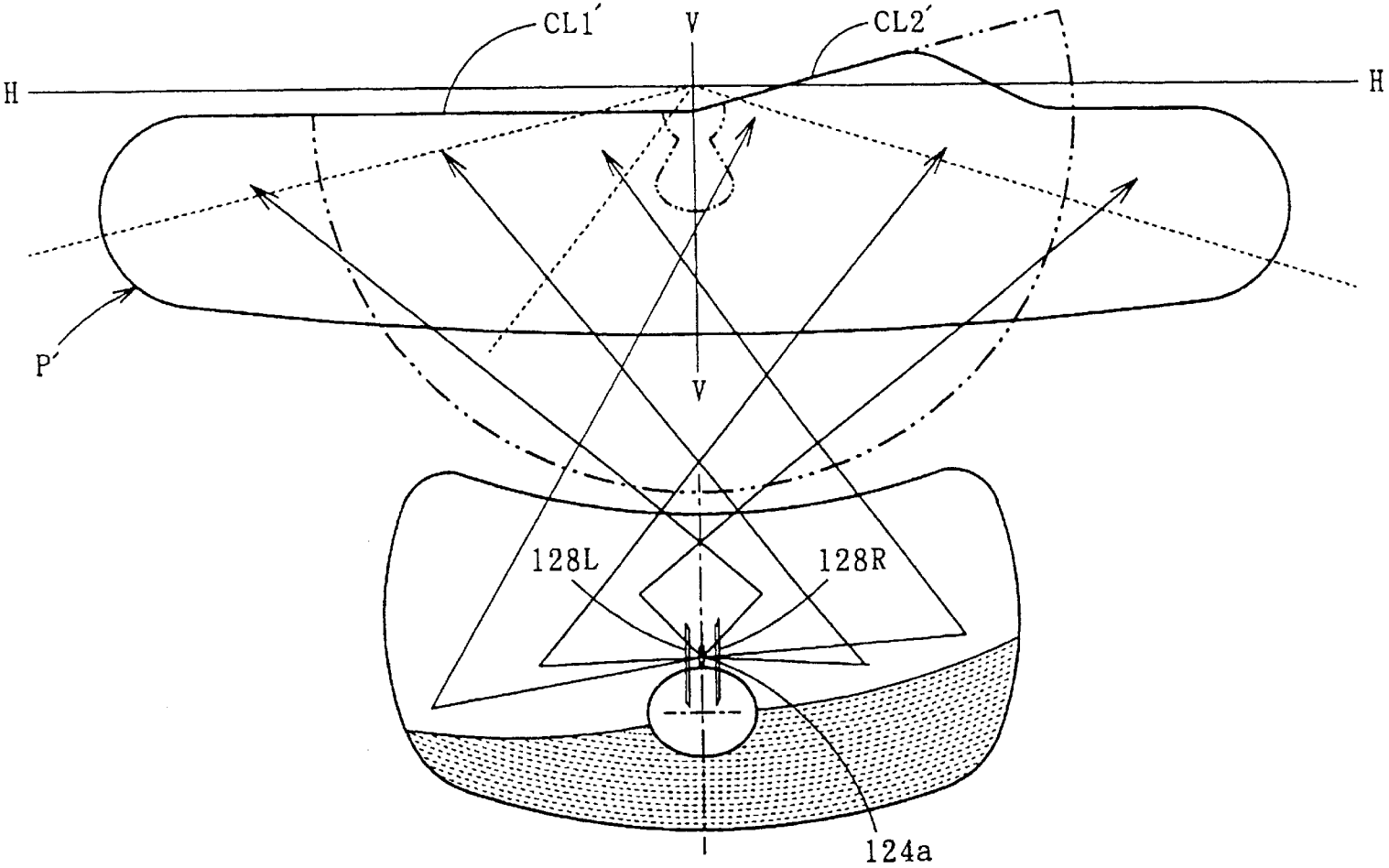
FIG. 8 PRIOR ART
FIG. 8 illustrates a light distribution pattern for low-beam emission of a conventional vehicular headlamp which is similar to FIG. 3.

FIG. 6 shows, together with the reflector unit 16, a light distribution pattern P for low-beam emission of the vehicular headlamp 30.

As shown in FIG. 6, also, according to the present embodiment, if it is assumed that the reflecting surface 20*a* is a paraboloid, the center of which is the optical axis Ax1, the light distribution pattern $P_o$ is a substantially semicircular light distribution pattern, the upper edge of which is located slightly below the line H. The upper edge of the light distribution pattern $P_o$ is horizontal because the discharge bulb 18 has been offset upward. It is to be noted herein that due to the effect of the offsetting of the discharge bulb 18, the light distribution pattern $P_o$ has a slightly flatter shape than that of the first embodiment.

Also in the present embodiment, the light distribution pattern $P_o$ is transformed through a diffusion-deflection reflection control function of the reflector elements 20*s* formed on the reflecting surface 20*a*. Thereby, as in the first embodiment, the light distribution pattern P having the left and right horizontal cut-off lines CL1, CL2 (that are on different levels) is formed. As in the first embodiment, in order to form the right-side horizontal cut-off line CL2 in the light distribution pattern P, the reflector elements 20*s* at the left end area 20*a*1 of the reflecting surface 20*a* are designed to reflect light from the discharge light-emitting portion 24*a* upward in a deflecting manner.

As described above, the light distribution pattern P having the horizontal cut-off lines CL1, CL2 that are on different levels is obtained, and the present embodiment also provides a vehicular headlamp using a discharge bulb as a light source, and having a light distribution pattern for low-beam emission that facilitates driving of the vehicle, and minimizes the risk of dazzling drivers of oncoming vehicles.

In addition, the present embodiment employs the discharge bulb 18 wherein the angle between the upper edges 28L*a*, 28R*a* of the black stripes 28L, 28R constituting the glare protection film 28 is 165°. Therefore, an existing discharge bulb (i.e., a discharge bulb on which the glare protection film 28 is formed so as to form a horizontal cut-off line and a cut-off line forming an angle of 15° therewith) can directly be used. Accordingly, it is possible to obtain the light distribution pattern P at low cost.

Further, in the present embodiment, the angular range for formation of the glare protection film 28 is smaller than that of the first embodiment by 15° (in other words, the angular range of the area above the glare protection film 28 is greater than that of the first embodiment by 15°). Hence, in accordance with the difference in angular range, the light flux from the light source utilized for low-beam emission increases, which enhances the efficiency of the lighting fixture.

Further, in the present embodiment, since the discharge bulb 18 is offset upwards, a high light intensity area in the light distribution pattern $P_o$ is formed closer to the upper edge thereof in comparison to the first embodiment. Therefore, the diffusion-deflection reflection control of the reflector 20, performed to transform the light distribution pattern $P_o$ into the light distribution pattern P, can be facilitated.

In the aforementioned respective embodiments, the discharge bulb 18 having the glare protection film 28 that is composed of a pair of the left and right black stripes 28L, 28R is employed, and the shade 22 blocks the light travelling downward from the discharge light-emitting portion 24*a* through the section between the black stripes 28L, 28R where the glare protection film is not formed.

In the first embodiment, since the specification of the bulb employed is modified from that of the existing discharge bulb, it is also possible to employ a discharge bulb having the glare protection film 28 that is formed over the entire angular range between the upper edges 28L*a*, 28R*a* of the black stripes 28L, 28R. In addition to the aforementioned operation and effect, this construction makes it possible to enhance a degree of freedom for the shape of the shade 22. Also, if the discharge bulb having the glare protection film 28 that is formed over the entire angular range between the upper edges 28L*a*, 28R*a* of the black stripes 28L, 28R is employed in the second embodiment, the degree of freedom for the shape of the shade 22 can also be enhanced, in spite of a lack of the aforementioned benefit regarding the possibility of direct use of the existing bulb.

Further, in the aforementioned respective embodiments, the light distribution pattern P having the left and right horizontal cut-off lines CL1, CL2 on different levels, and the light distribution pattern with the high-level horizontal cut-off line CL2 coincident with the line H is used. However, a light distribution pattern for low-beam emission that facilitates driving of the vehicle, and reduces risk of dazzling drivers of oncoming vehicles, it is not required to have the horizontal cut-off line CL2 coincident with the line H. The horizontal cut-off line CL2 may be located either above or below the line H.

Furthermore, in the aforementioned respective embodiments, the substantially semicircular light distribution pattern $P_o$ is transformed into the light distribution pattern P through the diffusion-deflection reflection control of the reflector 20, and the lens 12 is transparent. However, a lens step or the like may be formed in the lens 12 so that the aforementioned pattern can be transformed through diffusion-deflection penetration control of the lens step or the like. In this case, substantially the is same operation and effect can be achieved as in the aforementioned respective embodiments.

Further, in the aforementioned respective embodiments, the construction of the lighting fixture for obtaining the light distribution pattern P for right-side light distribution has been explained. However, by transposing the construction of the lighting fixtures in the aforementioned respective embodiments in the left-and-right direction, it is possible to obtain a light distribution pattern for left-side light distribution, which is symmetrical to the light distribution pattern P in the left-and-right direction. Also in this case, substantially the same operation and effect can be achieved as in the aforementioned respective embodiments.

It should further be apparent to those skilled in the art that various changes in form and detail of the invention as shown and described above may be made. It is intended that such changes be included within the spirit and scope of the claims appended hereto.

What is claimed is:

1. A vehicular headlamp assembly comprising:

a discharge bulb comprising an arc tube having a discharge light-emitting portion extending in a fore-to-aft direction, and an outer tube tubularly surrounding the arc tube, said discharge bulb further comprising an opaque glare protection film formed on an outer peripheral surface of the outer tube over a predetermined angular range and extending in the fore-to-aft direction of said outer tube such that upper edges of said glare protection film are located on left and right sides of said outer peripheral surface; and a reflector supporting said discharge bulb and forwardly reflecting light from a discharge light-emitting portion of said discharge bulb, wherein said discharge bulb is supported by the reflector so that upper edges of said glare protection film are located substantially in a horizontal plane.

2. The vehicular headlamp assembly according to claim 1, wherein said predetermined angular range is 180° with a center thereof being coincident with said discharge light-emitting portion.

3. The vehicular headlamp assembly according to claim 1, wherein:

said predetermined angular range is 165° with a center thereof being coincident with said discharge light-emitting portion; and said discharge bulb is supported by said reflector so that an optical axis of said discharge bulb is offset upward by a predetermined angle with respect to an optical axis of said reflector.

4. The vehicular headlamp assembly according to claim 1, further comprising a shade, said shade being attached to said reflector and substantially surrounding a front end portion and a lower fore-to-aft portion of said discharge bulb so that light emitted from said discharge bulb is blocked in a forward and a downward direction.

5. The vehicular headlamp assembly according to claim 2, further comprising a shade, said shade being attached to said reflector and substantially surrounding a front end portion and a lower fore-to-aft portion of said discharge bulb so that light emitted from said discharge bulb is blocked in a forward and a downward direction.

6. The vehicular headlamp assembly according to claim 3, further comprising a shade, said shade being attached to said reflector and substantially surrounding a front end portion and a lower fore-to-aft portion of said discharge bulb so that light emitted from said discharge bulb is blocked in a forward and a downward direction.

7. The vehicular headlamp assembly according to claim 2, wherein said glare protection film comprises a pair of substantially rectangular opaque stripes extending the length of the outer tube and each having an angular width of 35°.

8. The vehicular headlamp assembly according to claim 3, wherein said glare protection film comprises a pair of substantially rectangular opaque stripes extending the length of the outer tube and each having an angular width of 25°.

9. The vehicular headlamp assembly according to claim 1, wherein said horizontal plane is substantially parallel to an optical axis of said discharge bulb.

10. The vehicular headlamp assembly according to claim 9, wherein said horizontal plane intersects said optical axis of said discharge bulb.

11. The vehicular headlamp assembly according to claim 9, wherein said horizontal plane is offset below said optical axis of said discharge bulb.

* * * * *